US006918378B2

(12) United States Patent
Usui et al.

(10) Patent No.: US 6,918,378 B2
(45) Date of Patent: Jul. 19, 2005

(54) HIGH-PRESSURE FUEL INJECTION PIPE

(75) Inventors: Masayoshi Usui, Numazu (JP); Kikuo Asada, Mishima (JP); Teruhisa Takahashi, Mishima (JP)

(73) Assignee: Usui Kokusai Sangyo Kaisha Limited (JP)

( * ) Notice: Subject to any disclaimer, the term of this patent is extended or adjusted under 35 U.S.C. 154(b) by 0 days.

(21) Appl. No.: 10/616,841

(22) Filed: Jul. 10, 2003

(65) Prior Publication Data

US 2005/0005913 A1 Jan. 13, 2005

(51) Int. Cl.[7] ..... F02M 55/02
(52) U.S. Cl. ..... 123/468; 29/890.142
(58) Field of Search ..... 123/468, 469, 123/456; 285/189, 197, 328, 329, 332.1, 332.2, 332.3

(56) References Cited

U.S. PATENT DOCUMENTS 4,881,763 A * 11/1989 Guido et al. ..... 285/382
5,957,507 A * 9/1999 Asada ..... 285/189
5,979,945 A 11/1999 Hitachi et al.
5,992,904 A 11/1999 Hitachi et al.
6,050,611 A 4/2000 Asada
6,070,618 A 6/2000 Iwabuchi
6,126,208 A 10/2000 Asada et al.
6,397,881 B1 6/2002 Asada et al.
6,408,826 B2 6/2002 Asada et al.
6,415,768 B1 7/2002 Usui
6,463,909 B2 10/2002 Asada et al.
6,494,183 B2 12/2002 Usui et al.

OTHER PUBLICATIONS

Nonpatent publication entitled Seamless Precision Steel Tube DIN 2391.

* cited by examiner

*Primary Examiner*—Mahmoud Gimie
(74) *Attorney, Agent, or Firm*—Gerald E. Hespos; Anthony J. Casella

(57) ABSTRACT

In a high pressure fuel injection pipe, pipe extension and heat treatment are repeated by using a header manufactured by transformation induced plastic type strength steel. A process for depositing residual austenite is then performed, after which a final pipe extension process is performed, and the joint portion is molded and bending processing is performed without performing perfect annealing at the size of a product.

12 Claims, 1 Drawing Sheet

HIGH-PRESSURE FUEL INJECTION PIPE

BACKGROUND OF THE INVENTION

1. Field of the Invention

The invention mainly relates to a fuel injection pipe (including a feed pipe and an injection pipe for a common-rail injection system) used in a fuel supply path of a diesel internal combustion engine.

2. Description of the Prior Art

A prior art fuel injection pipe for a diesel engine has a thick wall steel pipe 11 with a connecting head portion 12 that has a conical face 13 as shown in FIG. 1. Alternatively, the prior art fuel injection pipe may have a thick wall steel pipe 21 with a connecting head 22 having an outside arc sheet face 23, as shown in FIG. 2. The connecting head 12, 22 is molded by buckling processing using pressing pressure in the axial core direction using a punch member from the outward direction.

A steel pipe (STS370, 410 of JISG3455) of 340 N/mm$^2$ class to 410 N/mm$^2$ class in tensile stress generally has been used in the above-described fuel injection pipe. A cleaning technique has been developed by exhaust gas regulation of the diesel engine. The technique more perfectly sets the fuel within an engine cylinder by increasing the pressure of the fuel and injecting the fuel as fine particles for cleaning the exhaust gas. Accordingly, a high internal pressure equal to or higher than the conventional 1200 bar is loaded in the fuel injection pipe. Therefore, high internal pressure fatigue strength is required. As a countermeasure, a high tensile steel pipe of 490 N/mm$^2$ class to 600 N/mm$^2$ class in tensile stress tends to be used.

Such a high tensile steel pipe generally is manufactured by a drawing process. The high tensile steel pipe manufactured by the drawing process is manufactured by hot processing from an ingot, and is processed to a required size by the drawing process (pipe extension) from its thick diameter pipe. Thus, there is a case in which a fine wrinkle flaw (defect) of about 100 $\mu$m in depth is generated on the inner face of the steel pipe. It is known that this wrinkle flaw is caused by the difference in the flow of a material between the outside and the inside generated when the pipe diameter is reduced by a die from the outside of the pipe at the pipe processing time, and the pipe is rolled by a plug from the inside. Such a phenomenon is caused by the insufficiency of extension caused by approximately inverse proportion of the tension and the extension (ductility and processability). This phenomenon is generated greatly in the thick wall pipe. The inside wrinkles rolled by the plug also have small ductility. Thus, the inside wrinkles are left as flaw wrinkles. In particular, when a fine wrinkle flaw of about 100 $\mu$m in depth exists on the pipe inner face and a high internal pressure of 1200 bar to 1600 bar is repeatedly applied to the pipe interior, there is a possibility that fatigue breakdown is caused. Accordingly, the pipe may burst due to stress concentration caused in this wrinkle flaw portion.

The above wrinkle flaw on the pipe inner circumferential face is recognized as a starting point of the internal pressure fatigue breakdown and conventionally is removed by a special cutting technique. The special cutting can raise internal pressure fatigue strength. However, it was not possible to bear a pressure of about 1600 bar or more from a limit of the strength of a material. In contrast, almost no vibrational fatigue strength is almost raised. Hence, there is no effect with respect to the vibrational fatigue breakdown advanced with the outer surface as a starting point.

An autofrettage method exists for generating compression residual stress on the inner surface by applying the pressure to the pipe interior. However, in this method, there is a case in which the distribution of the residual stress is changed by subsequent elastic deformation, and is vanished. Further, when the compression residual stress is generated on the inner surface, the inner surface is processed and hardened, but the inner surface fatigue strength is insufficient approximately in the normal processing-hardening of a material. The vibrational fatigue is mainly advanced with the outer surface of the pipe as a starting point, but no strength of the outer surface is improved at all. Therefore, no vibrational fatigue characteristics were improved at all.

The present invention is made to solve such conventional problems, and an object of the present invention is to provide a high pressure fuel injection pipe excellent in internal pressure fatigue resisting characteristics, vibrational fatigue resisting characteristics and cavitation resisting property, and also excellent in sheet face flawing resisting property and bending shape stable property, and made thin and light in weight.

SUMMARY OF THE INVENTION

In a high pressure fuel injection pipe according to the one aspect of the present invention, pipe extension and heat treatment are repeated by using a header manufactured by transformation induced plastic type strength steel having high tension in comparison with STS370, 410 of JISG3455, etc. without performing processing described later. Processing then is performed for depositing residual austenite and final pipe extension processing is performed. The high tension is raised further by molding a joint portion and performing bending without performing perfect annealing at the size of a product so that internal pressure and bending fatigue strength are raised. In high pressure fuel injecting pipe according to another aspect of the present invention, pipe extension and heat treatment are repeated by using a header manufactured by transformation induced plastic type strength steel. The header is finished at a product size via a final pipe extension process. Processing then is performed for depositing residual austenite. A joint portion is molded and bending processing is performed, and the inner surface layer of a manufactured pipe body is plastically processed so that a martensitic transformation is induced and high strength is set by further raising high tension.

In high pressure fuel injecting pipe according to still another aspect of the present invention, flaw removal processing on the inner surface of a steel pipe having a transformation induced plastic type strength steel component and pipe extension processing are performed. The steel pipe is finished at a predetermined desirable size and then is heated to 950° C. and is set to an austenite single layer and then is cooled suddenly. Austemper processing is performed at 350 to 500° C., and the inner surface is smoothed after the cooling. A joint portion then is molded and bending processing is performed so that internal pressure and bending fatigue strength are raised. Further, the martensitic transformation is induced by performing plastic processing after the above bending processing, and high strength is set.

It is possible to use a method in which only the inner circumferential surface is plastically deformed (autofrettage-processed) by applying internal pressure in the above plastic processing. Further, cleaning processing of the inner surface maybe performed at least once after the smoothing of the inner surface, the molding of the joint portion, or the bending processing.

DETAILED DESCRIPTION OF PREFERRED EMBODIMENTS

Figure 1:
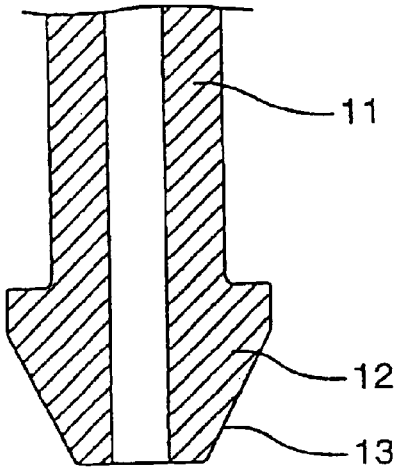
Fig. 1 PRIOR ART
FIG. 1 is a sectional view of a main portion showing one embodiment of a high pressure fuel injection pipe as an object of the present invention.
Figure 2:
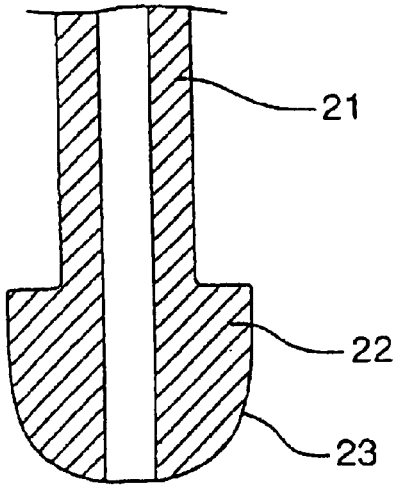
Fig. 2 PRIOR ART
FIG. 2 is a sectional view of a main portion showing another embodiment of high pressure fuel injection pipe as an object of the present invention.

Transformation induced plastic type strength steel of the present invention is developed for making a press molding part around a foot in a passenger care light in weight in recent years. This transformation induced plastic type strength steel is ferrite ($\alpha_f$)+bainite ($\alpha_b$)++$\gamma_R$ composite texture steel [TRIP type Dual-Phase steel, TDP steel], and bainitic ferrite ($\alpha_{bf}$)+$\gamma_R$ steel [TRIP type bainite steel, TB steel] in which press molding property is greatly improved by utilizing the strain induced transformation (TRIP) of residual austenite ($\gamma$R).

The transformation induced plasticity is the large extension of an austenite ($\gamma$) layer existing in a scientifically unstable state caused in transformation to martensite by adding mechanical energy.

TRIP steel is steel in which the metallic texture of a mixture of the residual austenite and the bainite texture with the grain boundary of an $\alpha$-layer as a center is obtained by taking a specific heat treatment in a certain limited steel. The TRIP steel having such a metallic texture has a high plastic deformation ability. The TRIP steel also is high in strength and becomes hard since the TRIP steel becomes a martensite texture by processing.

The high pressure fuel injection pipe of the present invention is manufactured by the transformation induced plastic type strength steel having such characteristics. Thus, this high pressure fuel injection pipe has good processability during the processing and has a smooth inner surface with no flaws. Further, a reduction at the extending time of the pipe can be large when the pipe is being extended, and hence the number of extending times of the pipe can be reduced. Further, the processing can be performed by a small pipe extending machine and a small die if the reduction is the same.

The injection pipe had the austenite ($\gamma$) texture. However, both hardness and tensile strength are improved by deposition of the processed induced martensite. Accordingly, internal pressure fatigue resisting characteristics, cavitation resisting property, the flawing resisting property of a sheet face, and bending shape stable property are excellent.

The transformation induced plastic type strength steel has characteristics (TRIP phenomenon) in which the austenite of a locally deformed portion is transformed to hard martensite, and its portion is strengthened. Accordingly, fatigue resistance of the high pressure fuel injection pipe manufactured by this transformation induced plastic type strength steel is strengthened, even when vibrational fatigue and internal pressure fatigue are advanced. Accordingly, resistance force for preventing breakdown of the pipe is generated. Therefore, the high pressure fuel injection pipe has long life in comparison with the conventional STS370, 410 of J1SG3455.

The method plastically deforms (autofrettage processing) only the inner circumferential surface by applying the internal pressure to a plastic processing means because residual stress due to the autofrettage is effective with respect to the internal pressure fatigue strength. The autofrettage processing slightly processes and hardens an inner surface layer. Thus, durability is also improved in this respect. Further, when this kind of steel is used, hardness is greatly increased and the internal pressure fatigue strength is increased.

TRIP type bainite steel (TB steel) having components shown in Table 1 is manufactured to provide a seamless steel pipe (header) having a 34 mm outside diameter, a 4.5 mm wall thickness and a 25 mm inside diameter. Pipe extension and annealing are repeated for 20 minutes at 950° C. so that the steel is changed to austenite. Thereafter, austemper processing is performed for three minutes in a range of 350 to 475° C. for holding the austenite. Thereafter, the final pipe extension processing is performed to obtain a pipe manufactured by TB steel having a 6 mm outside diameter, a 2 mm wall thickness and a 2 mm inside diameter. No annealing is performed at the product size. However the product is formed by molding a joint portion and performing bending processing.

The obtained product was preferable in both the internal pressure fatigue resisting characteristics and the vibrational fatigue resisting characteristics due to the martensitic transformation induced by the final pipe extension processing. Further, a bending shape stable property is preferable since the TRIP type bainite steel has high deformation ability.

Further, TRIP type bainite steel (TB steel) having components shown in Table 1 is manufactured and formed into a seamless steel pipe (header) having a 34 mm outside diameter, a 4.5 mm wall thickness and a 25 mm inside diameter. Pipe extension and annealing are repeated, and a final pipe extension processing is performed to obtain a pipe manufactured of TB steel having a 6 mm outside diameter, a 2 mm wall thickness and a 2 mm inside diameter. The obtained pipe manufactured of the TB steel is changed to austenite by heating for 20 minutes at 950° C. Thereafter, austemper processing is performed for three minutes in a range of 350 to 475° C. for holding the austenite. Thereafter, a joint portion is molded and bending processing and autofrettage processing (the internal pressure is 50% of the wall thickness) are performed at the product size.

In this embodiment, the obtained product has excellent internal pressure fatigue resisting characteristics due to the martensitic transformation induced by the final pipe extension processing, and also has a preferable bending shape stable property.

Further, TRIP type bainite steel (TB steel) having components shown in Table 1 is manufactured and formed into a seamless steel pipe (header) having an 18 mm outside diameter, a 3.8 mm wall thickness and a 10.4 mm inside diameter. Flaw removal processing of the inner surface is performed by cutting processing, and predetermined pipe extension and annealing are repeated. Thereafter, the final pipe extension processing is performed to obtain a pipe manufactured of TB steel having a 6 mm outside diameter, a 1.8 mm wall thickness and a 2.4 mm inside diameter. The obtained pipe manufactured of the TB steel is changed to austenite by heating for 20 minutes at 950° C. Thereafter, austemper processing is performed for three minutes at a temperature of 400° C., and the austenite is cooled. Thereafter, outer surface rust prevention processing is performed. A joint portion then is molded and bending processing is performed at the product size so that the product is formed.

In this embodiment, the obtained product has excellent internal pressure fatigue resisting characteristics due to the martensitic transformation induced by the final pipe extension processing, and also has a preferable bending shape stable property.

After the joint portion is molded or the bending processing is performed at the product size, similar effects are naturally obtained even when cleaning processing of the inner surface is performed.

Further, TRIP type bainite steel (TB steel) having components shown in Table 1 is manufactured and formed into a seamless steel pipe (header) having an 18 mm outside diameter a, 3.8 mm wall thickness and a 10.4 mm inside diameter. Flaw removal processing of the inner surface is performed by cutting processing. Pipe extension and annealing are repeated, and a final pipe extension processing is performed to obtain a pipe manufactured of TB steel having a 6 mm outside diameter, a 1.8 mm wall thickness and a 2.4 mm inside diameter. The obtained pipe manufactured of the TB steel is changed to austenite by heating for 20 minutes at 950° C. Thereafter, austemper processing is performed for three minutes at a temperature of 400° C. for holding the austenite, and the austenite is cooled. Thereafter, inner surface cleaning processing and outer surface rust prevention processing are performed. A joint portion then is molded and bending processing and autofrettage processing (the internal pressure is 50% of the wall thickness) are performed at the product size so that the product is formed.

In this embodiment, the obtained product also has excellent internal pressure fatigue resisting characteristics due to the martensitic transformation induced by the final pipe extension processing, and also has a preferable bending shape stable property.

For comparison, a pipe extension finished product was manufactured by using the seamless steel pipe manufactured using normal high strength steel (SCM435) (C 0.33 to 0.38 mass %, Si 0.15 to 0.35 mass %, Mn 0.60 to 0.85 mass %, P 0.030 mass % or less, S 0.030 mass % or less, Cr 0.90 to 1.20 mass %, and Mo 0.15 to 0.30 mass %). The molding of a head portion and the bending processing could not be performed by processing-hardening. Further, no bending processing was performed when the normal heat treatment (quenching and tempering) was executed.

TABLE 1

| C | Si | Mn | Al |
|---|---|---|---|
| 0.17 | 1.41 | 2.02 | 0.032 |

(mass %)

As explained above, the high pressure fuel injection pipe of the present invention has high plastic deformation ability and also has a martensite texture due to plastic processing. Therefore, the high pressure fuel injection pipe is manufactured by transformation induced plastic type strength steel high in both strength and hardness. Therefore, the entire pipe has high strength and high hardness and is excellent in internal pressure fatigue resisting characteristics, vibrational fatigue resisting characteristics, cavitation resisting property, flawing resisting property of a sheet face and bending shape stable property. The entire pipe can be also made thin and light in weight.

Further, the high pressure fuel injection pipe has good processability during the processing, and also has a smooth inner surface (having no flaw). Further, a reduction during the pipe extending is large. Therefore, the number of pipe extending times can be reduced. Further, if the reduction is the same, there are effects in that the processing can be performed by a small pipe extending machine and a small die, etc.

What is claimed is:

1. A high pressure fuel injection pipe in which pipe extension and heat treatment are repeated on a pipe manufactured from transformation induced plastic type strength steel, and processing for depositing residual austenite is then performed and final pipe extension processing is performed, and internal pressure and bending fatigue strength are raised by molding a joint portion and performing bending processing without performing perfect annealing at a size of the pipe after the repeated extension and heat treatment.

2. The high pressure fuel injection pipe according to claim 1, wherein the transformation induced plastic type strength steel is ferrite ($\alpha_f$)+bainite ($\alpha_b$)+$\gamma_R$ composite texture steel, and bainitic ferrite ($\alpha_{bf}$)+$\gamma_R$ steel in which press molding property is improved by utilizing strain induced transformation of the residual austenite ($\gamma_R$).

3. A high pressure fuel injection pipe in which pipe extension and heat treatment are repeated on a pipe manufactured from transformation induced plastic type strength steel, and the header is finished at a product size via a final pipe extension process, and processing for depositing residual austenite is then performed, and a joint portion is molded and bending processing is performed, and the inner surface layer of a manufactured pipe body is plastically processed so that a martensitic transformation is induced and high strength is set.

4. The high pressure fuel injection pipe according to claim 3, wherein the transformation induced plastic type strength steel is ferrite ($\alpha_f$)+bainite ($\alpha_b$)+$\gamma_R$ composite texture steel, and bainitic ferrite ($\alpha_{bf}$)+$\gamma_R$ steel, in which press molding property is improved by utilizing strain induced transformation of the residual austenite ($\gamma_R$).

5. The high pressure fuel injection pipe according to claim 3, wherein only a inner circumferential surface is plastically deformed by applying internal pressure in the plastic processing.

6. A high pressure fuel injection pipe in which flaw removal processing on the inner surface of a steel pipe having a transformation induced plastic type strength steel component and pipe extension processing are performed, and the steel pipe is finished at a predetermined desirable size and is then heated to 950° C. and is set to an austenite single layer and is then suddenly cooled, and austemper processing is performed at 350 to 500° C., and the inner surface is smoothed after the cooling, and a joint portion is then molded and bending processing is performed so that internal pressure and bending fatigue strength are raised.

7. The high pressure fuel injection pipe according to claim 6, wherein the transformation induced plastic type strength steel is ferrite ($\alpha_f$)+bainite ($\alpha_b$)+$\gamma_R$ composite texture steel, and bainitic ferrite ($\alpha_{bf}$)+$\gamma_R$ steel in which press molding property is greatly improved by utilizing strain induced transformation of the residual austenite ($\gamma_R$).

8. The high pressure fuel injection pipe according to claim 6, wherein cleaning processing of a inner surface is performed at least once after the smoothing of the inner surface, the molding of the joint portion, or the bending processing.

9. A high pressure fuel injection pipe in which flaw removal processing on the inner surface of a steel pipe having a transformation induced plastic type strength steel component and pipe extension processing are performed, and the steel pipe is finished at a predetermined desirable size and is then heated to 950° C. and is set to an austenite single layer and is then suddenly cooled, and austemper processing is performed at 350 to 500° C., and the inner surface is smoothed after the cooling, and a joint portion is then molded and bending processing is performed, and plastic processing is further performed after said bending processing so that a martensitic transformation is induced and high strength is set.

10. The high pressure fuel injection pipe according to claim 9, wherein the transformation induced plastic type strength steel is ferrite ($\alpha_f$)+bainite ($\alpha_b$)+$\gamma_R$ composite texture steel, and bainitic ferrite ($\alpha_{bf}$)+$\gamma_R$ steel in which press molding property is greatly improved by utilizing strain induced transformation of the residual austenite ($\gamma_R$).

11. The high pressure fuel injection pipe according to claim 9, wherein only the inner circumferential surface is plastically deformed by applying internal pressure in the plastic processing.

12. The high pressure fuel injection pipe according to claim 9, wherein cleaning processing of an inner surface is performed at least once after the smoothing of the inner surface, the molding of the joint portion, and the bending processing.

* * * * *